US006382690B1

(12) United States Patent
Dessenberger, Jr.

(10) Patent No.: US 6,382,690 B1
(45) Date of Patent: May 7, 2002

(54) KEEPER MECHANISM

(75) Inventor: Arthur W. Dessenberger, Jr., Tehachapi, CA (US)

(73) Assignee: Hartwell Corporation, Placentia, CA (US)

( * ) Notice: Subject to any disclaimer, the term of this patent is extended or adjusted under 35 U.S.C. 154(b) by 16 days.

(21) Appl. No.: 09/670,655

(22) Filed: Sep. 27, 2000

(51) Int. Cl.[7] ..... E05B 15/02
(52) U.S. Cl. ..... 292/341.18; 292/340; 292/113
(58) Field of Search ..... 292/340, 341.18, 292/113, 100

(56) References Cited

U.S. PATENT DOCUMENTS

| | | | | | |
|---|---|---|---|---|---|
| 4,320,912 | A | * | 3/1982 | Grace et al. | 292/341.18 |
| 4,421,349 | A | * | 12/1983 | Greiert, Jr. | 292/19 |
| 4,538,843 | A | * | 9/1985 | Harris | 292/113 |
| 4,557,441 | A | * | 12/1985 | Aspinall | 244/129.4 |
| 4,691,952 | A | * | 9/1987 | Harmon | 292/341.18 |
| 4,798,408 | A | * | 1/1989 | Harmon et al. | 292/341.18 |
| 4,906,037 | A | * | 3/1990 | Stammreich et al. | 292/341.18 |
| 5,076,514 | A | * | 12/1991 | Melcher | 244/129.4 |
| 5,620,212 | A | | 4/1997 | Bourne et al. | 292/113 |

OTHER PUBLICATIONS

Drawing of H245.
Drawing of HA 306.
Drawing of H 2800.

* cited by examiner

*Primary Examiner*—Teri Pham Luu
(74) *Attorney, Agent, or Firm*—Barnes & Thornburg

(57) ABSTRACT

Disclosed is a keeper mechanism utilized with a latch having a hook. The keeper mechanism includes a housing, housing extension, clevis, adjusting nut, biasing spring, retaining ring, detent spring, indicator, and indicator spring. The housing includes exterior and interior surfaces, a mounting wall, and an adjustment slot adjacent the mounting wall. The mounting wall connects to one end of the housing and includes an opening. One end of the housing extension protrudes from the exterior surface of the housing while the other end includes an indicator opening. The clevis includes a clevis opening and clevis shaft which passes through the opening and extends inside the housing. The adjusting nut is threadably mounted to the clevis shaft and includes a plurality of grooves. One end of the biasing spring is adjacent the mounting wall while the other end interfaces the adjusting nut. The retaining ring connects to the interior surface of the housing between the adjustment slot and the housing extension. The detent spring mounts to the interior surface of the housing and has at least one knee in contact with at least one of the plurality of grooves. The indicator is housed within the housing extension and includes a bulb-shaped sensing end which engages the adjusting nut, lip adjacent the bulb-shaped sensing end, flag end positioned adjacent the indicator opening, and cylindrical indicator shaft which extends from the lip to the flag end. The indicator spring surrounds the cylindrical indicator shaft.

22 Claims, 6 Drawing Sheets

KEEPER MECHANISM

BACKGROUND OF THE INVENTION

1. Field of the Invention

This invention relates to the mechanical arts. In particular, this invention relates to a keeper mechanism providing a visual signal indicating whether or not a latch is loaded.

2. Discussion of the Related Art

Various types of latches join and lock aircraft panels, such as aircraft cowlings, to one another. A typical latch includes a hook mounted to one aircraft panel that engages a keeper mounted to another aircraft panel. Furthermore, the latch generally includes a handle that actuates the hook through a linkage. When the handle is in the closed position and the hook is engaged with the keeper, the latch is closed securing the aircraft panels to one another. When the latch is closed, the hook imparts a certain amount of force, or load, upon the keeper. If necessary, the operator can release the aircraft panels from one another by rotating the handle to the open position such that the hook disengages from the keeper.

A problem with these latches is a ground crew inspector cannot visually verify whether or not the hook has properly engaged the keeper. Therefore, the inspector cannot be sure that the latch is properly closed. A further problem associated with these latches is that if the hook or the keeper are not in the proper position, or are broken, it is possible to close the latch without the hook properly engaging the keeper. This results in an unsafe condition in which the aircraft panels could open during flight.

Various types of indicators have been utilized with latches that join and lock aircraft panels to one another to provide a visual signal to ground crew inspectors indicating whether or not the hook and the keeper are properly engaged. For example, one type of indicator includes a feeler mechanism that fits over and slides relative to the hook. When the hook properly engages the keeper, the feeler mechanism engages the keeper and is positioned to allow the handle to close. On the other hand, when the hook does not properly engage the keeper, the feeler mechanism also does not engage the keeper, and the feeler mechanism prevents the handle from closing. Also, the handle remains pivoted upwards toward its open position, and does not match the contour of the aircraft panel. Thus, the handle's position is a signal to the ground crew inspector that the hook did not engage the keeper and the latch is not properly closed.

A disadvantage of such prior indicators is that they are mounted on the latching device and are readily accessible by the operator. Unfortunately, this means that the indicators are sometimes subject to extreme operator abuse and are often damaged, broken, or intentionally overridden by the operator. For example, the previously described feeler mechanism can be manually overridden by simply pulling the feeler mechanism into place such that the handle closes, even though, the hook is not engaged with the keeper. In extreme cases, an operator may simply break the feeler mechanism. Thus, there is a potential that the aircraft could fly in an unsafe condition. A further disadvantage of the prior indicators is that they only sense whether or not the hook has engaged the keeper and do not indicate if the hook has engaged the keeper with force such that the latch is in a loaded position.

A prior keeper mechanism, without an indicator, allows for the engagement of a hook with a keeper and the adjusting of the latch load. The keeper mechanism includes a housing, a clevis, having a clevis opening and a clevis shaft, an adjusting nut, and a detent spring. The clevis opening is located outside of the housing and the clevis shaft extends inside the housing. The adjusting nut is located inside the housing and is threadably mounted around the clevis shaft. A detent spring interfaces with the adjusting nut and prevents the adjusting nut from rotating. After the hook engages the clevis and the latch is closed, an operator can control the load imparted by the hook upon the keeper by adjusting the position of the adjusting nut relative to the clevis opening.

A disadvantage of this type of keeper mechanism is that it is possible for the distance between the adjusting nut and the clevis opening to be great enough that when the latch is closed there is no load between the hook and keeper, and thus, the keeper cannot provide a minimum load for the latch. Without a minimum load, the keeper cannot be secured. A further disadvantage of the keeper mechanism is that it does not provide a visual indication of whether or not the hook is properly engaged with the keeper such that the latch is closed and the hook imparts at least the requisite minimum load upon the keeper.

In view of the above, it should be appreciated that there is a need for a keeper mechanism that indicates whether or not the hook is engaged with the keeper such that the latch is closed and loaded, includes an indicator that is safe from operator abuse and cannot be manually overridden, and provides a minimum load for the latch. The present invention satisfies these and other needs and provides further related advantages.

SUMMARY OF THE INVENTION

The invention resides in a keeper mechanism. Various embodiments of the inventive he keeper mechanism provide advantages over known keeper mechanisms in that they indicate whether or not the hook is engaged with the keeper such that the latch is closed and loaded, includes an indicator that is safe from operator abuse and cannot be manually overridden, and/or provide a minimum load for the latch.

The keeper mechanism is utilized with a latch having a hook. The latch is moveable between an unloaded position and a loaded position. In one embodiment, the keeper mechanism include a housing, a housing extension, a clevis, an adjusting nut, a detent spring, and an indicator. The housing has an exterior surface and an interior surface. The housing also has opposing ends and a mounting wall connected to one end of the housing. The mounting wall includes an opening. The housing extension has opposing ends, with one of the opposing ends connected to the housing, such that the housing extension protrudes from the exterior surface of the housing. The other end of the housing extension includes an indicator opening. The clevis includes a clevis opening positioned outside of the housing, at one end of a clevis shaft. The clevis shaft passes through the opening in the mounting wall and extends into the housing. The adjusting nut is threadably mounted to the clevis shaft and is positioned within the housing. The detent spring mounts to the interior surface of the housing and is in sliding contact with the adjusting nut.

The indicator is housed within the housing extension and includes a bulb-shaped sensing end, which engages the adjusting nut, and a flag end, positioned adjacent the indicator opening. The indicator is moveable between a flagged position and an unflagged position. In the flagged position, the flag end extends outside of the housing extension and indicates when the latch is in an unloaded position. In the unflagged position, the flag end does not extend outside of the housing extension and indicates when the latch is in a loaded position. Thus, the flag end of the indicator provides a visual indication of whether or not the hook is properly engaged with the keeper and the latch is closed and in a loaded position. This is advantageous in that the indicator allows ground crew inspectors to visually verify the status of the latch. A further advantage of the invention is that the indicator is housed within the housing extension so the indicator is less susceptible to operator abuse.

In an alternative embodiment of the invention, the housing does not include a housing extension or an indicator. However, this embodiment does include a biasing spring which has opposing ends. One end of the biasing spring is positioned adjacent the mounting wall. The other end of the biasing spring interfaces with the adjusting nut. The biasing spring advantageously provides a minimum load for the latch. It is advantageous for the latch to have a minimum load, since with a minimum load, it is known that when the latch is closed the hook and the keeper mechanism are linked together by at least a minimum amount of Another embodiment of the invention includes the housing extension, indicator, and biasing spring of the previous embodiments. This embodiment also includes an adjustment slot adjacent the mounting wall. The adjusting nut has a front section adjacent the end of the adjusting nut nearest the mounting wall. Additionally, the adjusting nut has an end section located at the end of the adjusting nut furthest from the mounting wall. The end section includes a plurality of grooves. A sloped surface is located between the front section and the end section. The detent spring has at least one knee which is in sliding contact with one of the plurality of grooves in the end section of the adjusting nut.

This embodiment also includes a retaining ring connected to the interior surface of the housing between the adjustment slot and the housing extension. In addition, the indicator includes a lip adjacent the bulb-shaped sensing end and a cylindrical indicator shaft extending from the bulb-shaped end to the flag end. An indicator spring is mounted inside of the housing extension and surrounds the cylindrical indicator shaft between the lip and the indicator opening. Thus, this embodiment includes the features and advantages of both prior embodiments of the invention since this embodiment includes the housing extension, the indicator, and the biasing spring.

Some embodiments of the present invention include a remote cabling system. One end of the remote cabling system connects to the flag end of the indicator. The other end of the remote cabling system connects to a remote flag, such that the remote flag is visible when the flag end extends outside of the housing extension.

Other embodiments of the present invention include an electronic monitoring device contacts the flag end of the indicator. The electronic monitoring device generates an electrical signal when the flag end extends outside of the housing extension.

The remote cabling system and electronic monitoring device are advantageous since they allow for remote monitoring of the latch. In particular, the remote cabling system and electronic monitoring device notify an observer at a location remote from the latch whether or not the latch is closed and in a loaded position.

Other features and advantages of the present invention will be set forth in part in the description which follows and the accompanying drawings, wherein the preferred embodiments of the present invention are described and shown, and in part will become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural, and functional details disclosed herein are not to be interpreted as limiting, but merely as a basis for the claims and as a representative basis for teaching one skilled in the art to variously employ the present invention in virtually any appropriately detailed structure.

Figure 1:
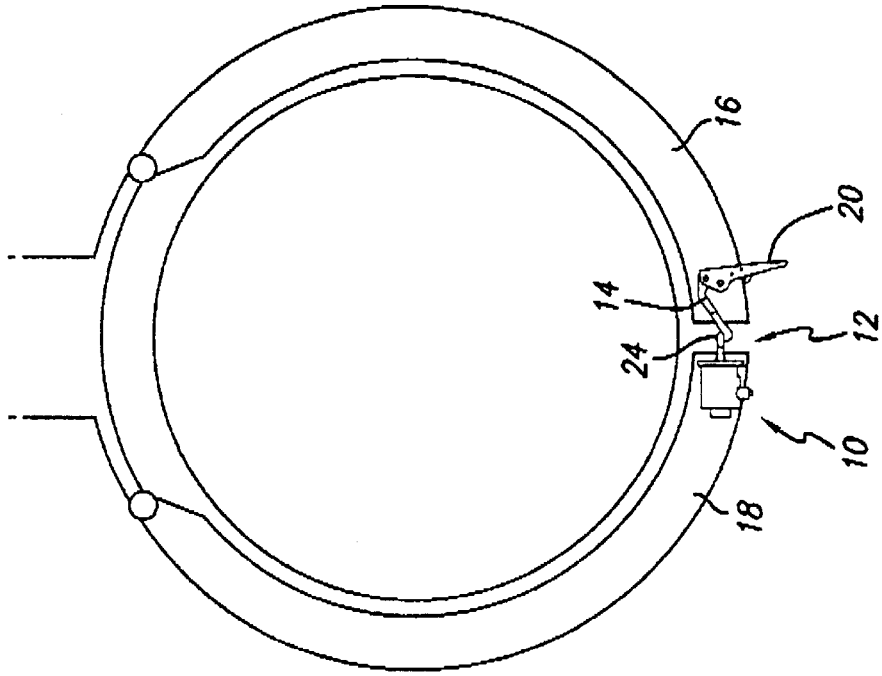
FIG. 1 is an elevational view showing a latch mounted to an aircraft panel with a handle in the open position and a hook engaging a keeper mechanism according to the present invention mounted to another aircraft panel.

As shown in the exemplary drawings, and with particular reference to FIG. 1, the present invention is embodied in a keeper mechanism 10, utilized with a latch 12, having a hook 14. The hook is mounted to a first aircraft panel 16 and engages the keeper mechanism which is mounted to a second aircraft panel 18. The latch includes a handle 20, shown in the open position, connected to the hook.

Figure 2:
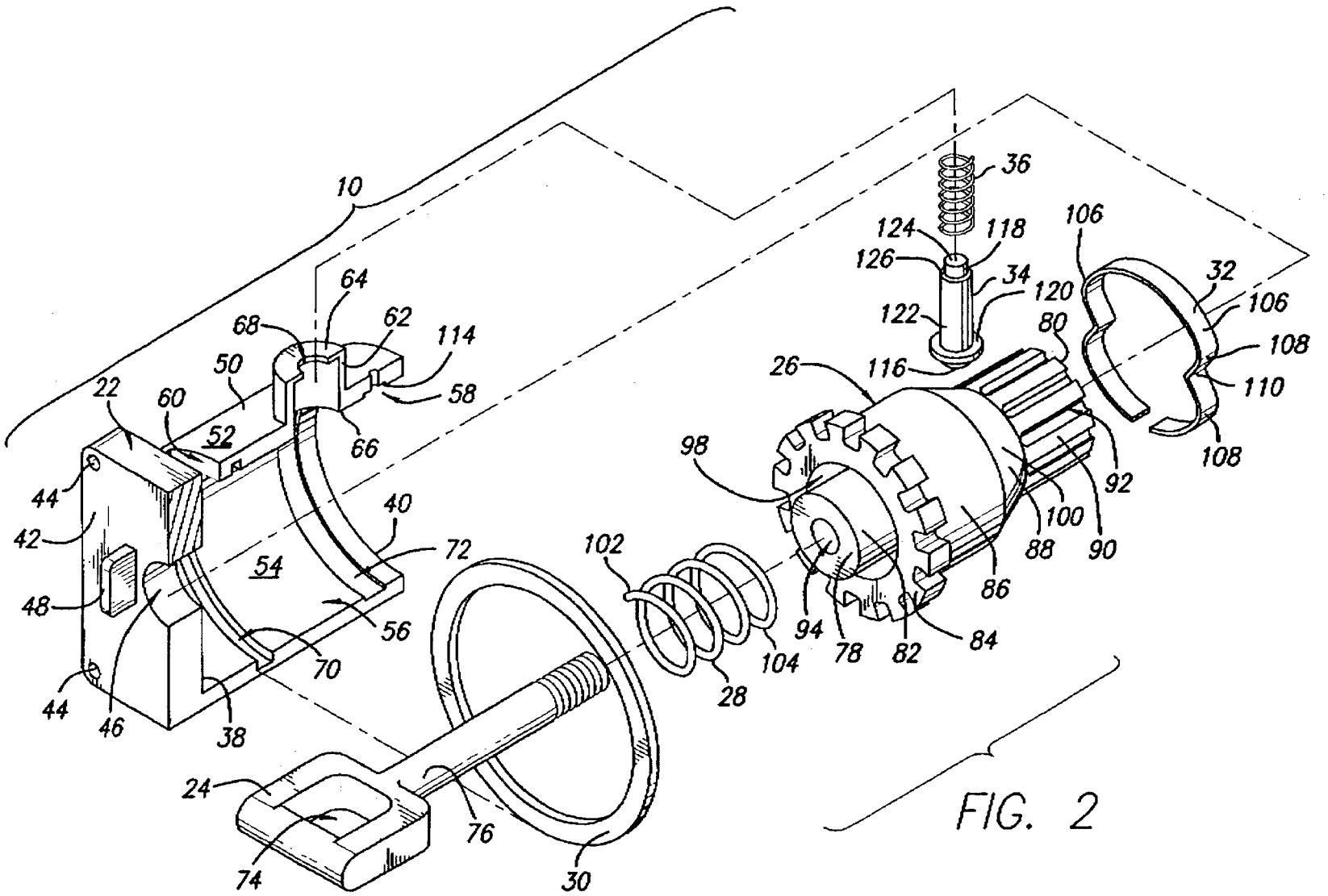
FIG. 2 is an exploded view of a keeper mechanism with a half-section of the housing removed.

With reference to FIG. 2, which is an exploded view of the keeper mechanism 10, the keeper mechanism includes a housing 22 (only a half-section is shown), a clevis 24, an adjusting nut 26, a biasing spring 28, a retaining ring 30, a detent spring 32, an indicator 34, and an indicator spring 36. Also, the housing has opposing ends 38, 40 with a mounting wall 42 connected to one end of the housing. The mounting wall is planar and has four latch mounting holes 44 (two shown) for mounting the keeper mechanism to the second aircraft panel 18 (as shown in FIG. 1) by nut and bolt assemblies (not shown). The mounting wall defines an opening 46. A pair of stops 48 (one shown) extend perpendicularly from the mounting wall on both sides of the opening.

The housing 22 also includes a cylindrical body 50, with an exterior surface 52 and an interior surface 54, that defines a cylindrically-shaped interior space 56 between the mounting wall 42 and an open end 58. The cylindrical body also defines an adjustment slot 60, adjacent to the mounting wall. A housing extension 62, having opposing ends 64,66, protrudes from the exterior surface of the housing with one end of the housing extension connected to the cylindrical body and the other end having an indicator opening 68. In addition, the cylindrical body includes a first circumferential groove 70 extending along the interior surface adjacent the adjustment slot, and a second circumferential groove 72 extending along the interior surface adjacent the open end.

Figure 3:
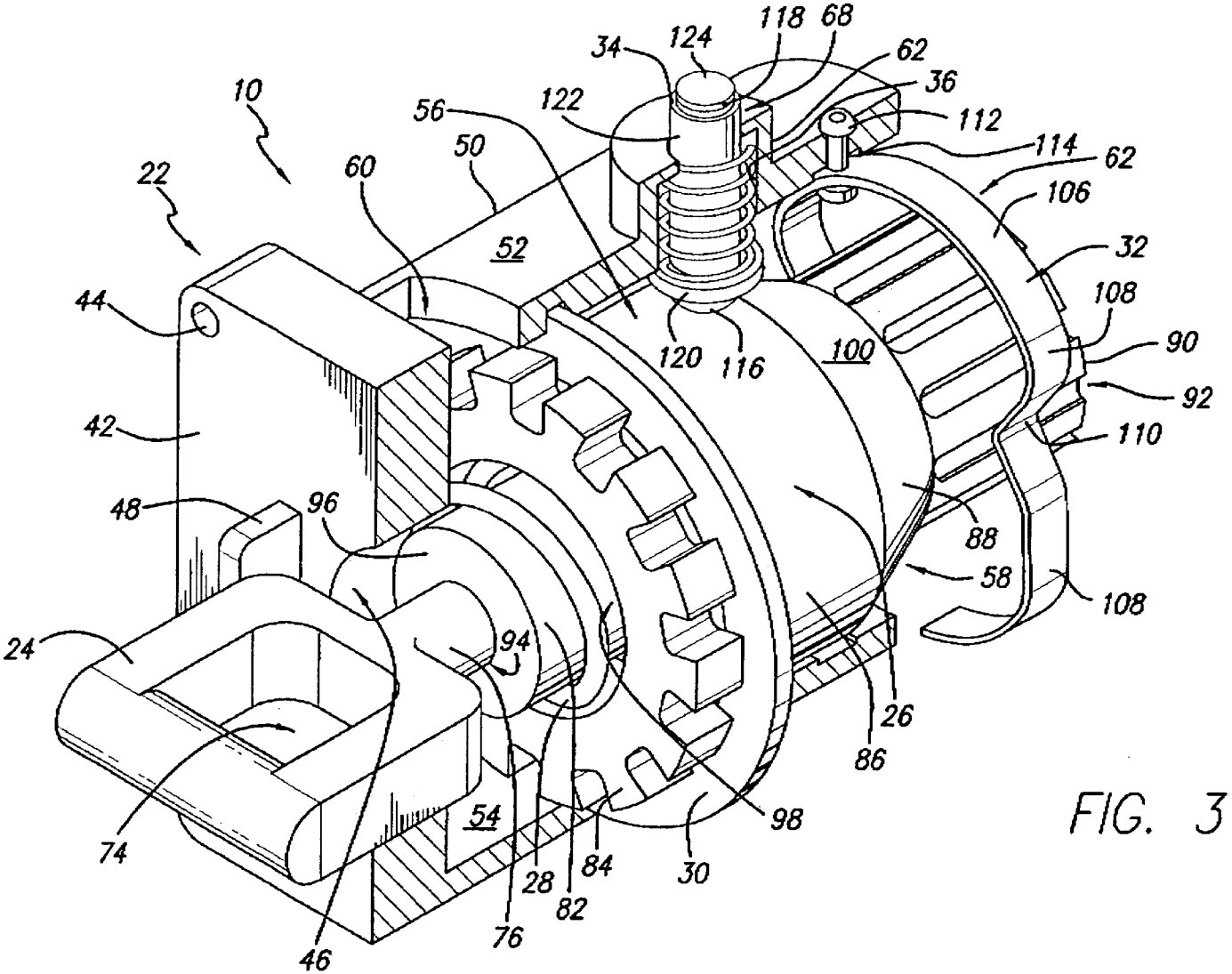
FIG. 3 is a perspective view of a keeper mechanism, with a half-section of the housing removed, illustrating a latch in an unloaded position and an indicator in a flagged position.

Referring also to FIG. 3, the clevis 24 is positioned in the housing 22 such that a clevis opening 74 is located outside of the housing, adjacent the mounting wall 42, and between the pair of stops 48 (one shown). As best seen in FIG. 2, the clevis also has a threaded cylindrical clevis shaft 76 which passes through the opening 46 in the mounting wall and extends into the cylindrically-shaped interior space 56 of the housing. The clevis is prevented from rotating by the pair of stops.

The adjusting nut 26 has opposing ends 78, 80, a cylindrical inner shaft 82, a radially notched ring 84, a cylindrical front section 86, a conical mid-section 88, and a cylindrical end section 90 having a plurality of grooves 92. The inner shaft has a bore 94 for accepting the clevis shaft 76 such that the clevis 24 and the adjusting nut are threadably mounted to one another within the interior space 56 of the housing 22. The inner shaft has a forward end 96 which slides within the opening 46 of the mounting wall 42 as the adjusting nut moves within the housing. A circumferential slot 98 is formed between both the inner shaft and the radially-notched ring, and between the inner shaft and the front section. The front section extends away from the radially-notched ring at the end of the adjusting nut nearest the mounting wall. The end section is located at the end of the adjusting nut furthest from the mounting wall. Each of the plurality of grooves in the end section is equidistantly spaced around the circumference of the end section. The mid-section is located between the front section and the end section and defines a conically-sloped surface 100.

The biasing spring 28 has opposing ends 102, 104 and is coaxially-located around the inner shaft 82 of the adjusting nut 26. One end of the biasing spring is adjacent the mounting wall 42. The other end of the biasing spring interfaces with the circumferential slot 98 of the adjusting nut. Advantageously, the biasing spring provides a minimum load for the hook 14 to overcome in securing the keeper mechanism 10 as the latch 12 is closed. Because of the load provided by the biasing spring, at least a minimum force links the hook to the keeper mechanism. The minimum load for the latch can be varied by utilizing different biasing springs.

The first circumferential groove 70 in the interior surface 54 of the housing 22 accepts the retaining ring 30 and locates the retaining ring coaxial to the adjusting nut 26 between the adjustment slot 60 and the housing extension 62. The inside diameter of the retaining ring is less than the outside diameter of the radially-notched ring 84. Also, the inside diameter of the retaining ring is sized such that it does not make contact with the rest of the adjusting nut. Therefore, the radially-notched ring abuts the retaining ring when the hook 14 does not engage the clevis 24 and pull the adjusting nut toward the mounting wall 42. Advantageously, the retaining ring limits the amount of travel of the adjusting nut within the housing so that the adjusting nut does not travel out the open end 58 of the housing's cylindrical body 50 and the clevis does not hit the mounting wall.

The detent spring 32 which consists of a curved piece of material having a pair of legs 106. Each leg has two curved sections 108 which form a knee 110. The second circumferential groove 72 accepts the detent spring and allows the detent spring to expand and contract within the housing 22. As shown in FIG. 3, a rivet 112 mounts the detent spring to the interior surface 54 of the housing at a fastening point 114 near the open end 58 of the housing. Each knee engages, in sliding contact, one of the plurality of grooves 92 in the end section 90 of the adjusting nut 26 and prevents the adjusting nut from rotating and self-adjusting due to aircraft vibration.

As best seen in FIGS. 2 and 3, the indicator 34 is plunger-shaped, having a sensing end 116 and a flag end 118. The indicator is housed within the housing extension 62. The sensing end is bulb-shaped and engages the adjusting nut 26. A lip 120 is located adjacent to the bulb-shaped sensing end and a cylindrical indicator shaft 122 extends from the lip to the flag end. The flag end terminates at a flat end 124 and is positioned adjacent the indicator opening 68. The flag end has a smaller diameter than the indicator shaft, resulting in a shoulder 126, formed between the indicator shaft and the flag end. The indicator spring 36 is positioned within the housing extension and around the indicator shaft between the lip and the indicator opening. Advantageously, the indicator is positioned safely within the housing extension so that an operator has little or no access to the indicator. Thus, the indicator is less likely to be damaged, overridden by the operator, or broken by the operator.

The method of use of the keeper mechanism 10, constructed as described above will now be described. Referring to FIG. 1, a latch operator opens the latch 12 by rotating the handle 20 to the open position such that the hook 14 disengages from the clevis 24. The operator can then release the first and second aircraft panels 16, 18 from one another. On the other hand, when the handle is in the closed position, the hook engages the clevis so that the first and second aircraft panels are secured to one another.

Figure 4A:
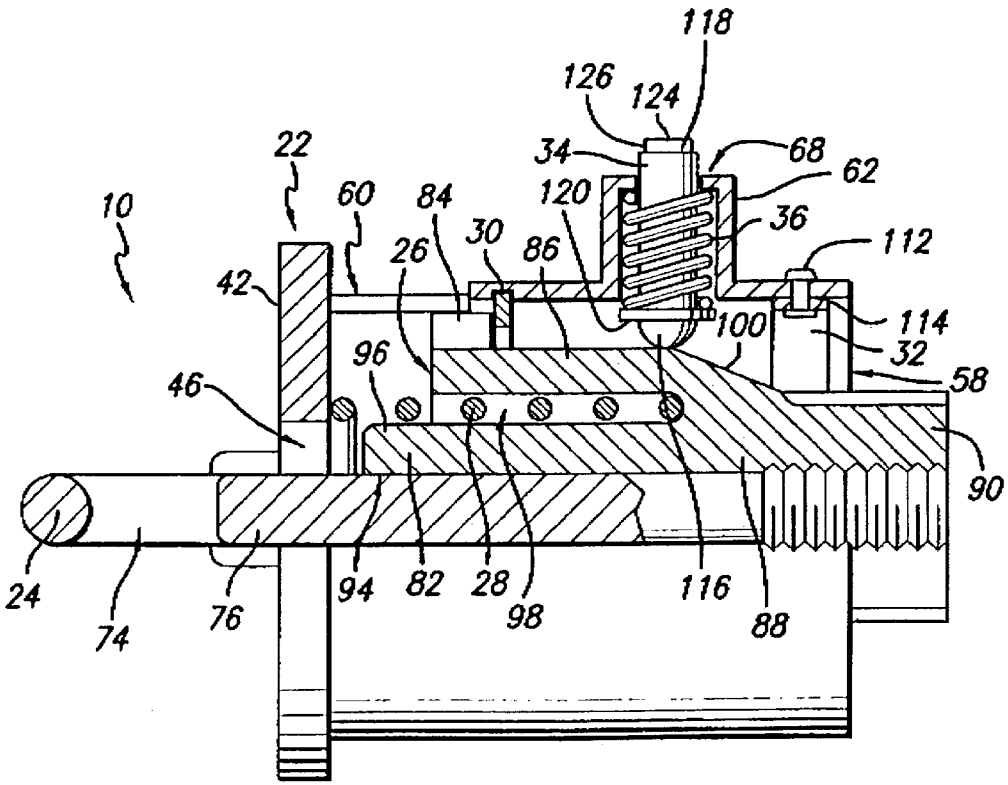
FIG. 4*a* is a partial sectional view of a keeper mechanism illustrating a latch in an unloaded position and an indicator in a flagged position.
Figure 4B:
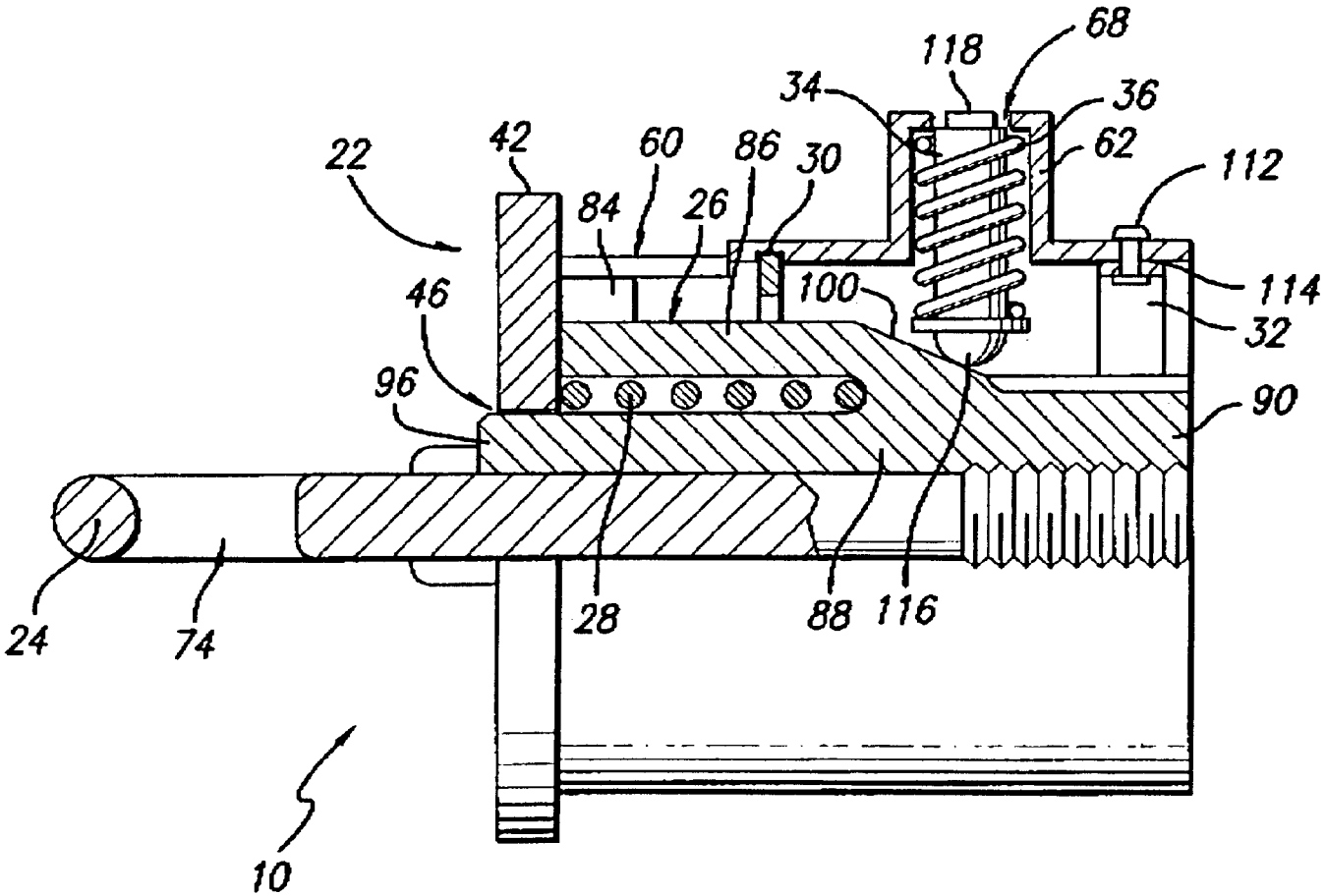
FIG. 4*b* is a partial sectional view of a keeper mechanism illustrating a latch in a loaded position and an indicator in an unflagged position.

Referring to FIGS. 4*a* and 4*b*, there is shown the keeper mechanism 10 and the latch 12 in an unloaded position and loaded position, respectively. Referring more particularly to FIG. 4*a*, when the operator closes the latch and the hook 14 does not engage the clevis 24, or the hook does not engage the clevis with force enough to overcome the load of the biasing spring 28, the biasing spring biases the adjusting nut 26 away from the mounting wall 42 and the radially-notched ring 84 abuts the retaining ring 30.

Turning to FIG. 4*b*, when the operator closes the latch 12 and the hook 14 engages the clevis 24 with force enough to overcome the load of the biasing spring 28, the latch is in its loaded position. In the loaded position, the force imparted by the hook pulls the adjusting nut 26 toward the mounting wall 42, and away from the retaining ring 30, such that the biasing spring is compressed and the radially-notched ring 84 bears against the mounting wall with the forward end 96 of the adjusting nut protruding slightly outside the opening 46 in the mounting wall.

As the adjusting nut 26 translates between the latches' 12 unloaded and loaded positions, the bulb-shaped sensing end 116 of the indicator 34 moves from a location at or near the interface of the front section 86 and the mid-section 88 to a location at or near the interface of the mid-section and the end section 90. Thus, as the adjusting nut translates, the flag end 118 of the indicator drops in height, moving from its flagged position, indicating that the latch is in an unloaded position, to its unflagged position, indicating that the latch is in a loaded position.

The position of the clevis opening 74 relative to the mounting wall 42 is changed by rotation of the radially-notched ring 84. An operator inserts a tool through the adjustment slot 60, and uses the tool to rotate the radially-notched ring such that the clevis opening moves toward or away from the mounting wall. Adjusting the position of the clevis opening relative to the mounting wall changes the distance that the hook 14 has to move the clevis 24, and thus, the biasing spring 28, as the latch 12 is closed. Therefore, adjusting the position of the clevis opening relative to the mounting wall adjusts the load, or the force required to close the latch.

Figure 5:
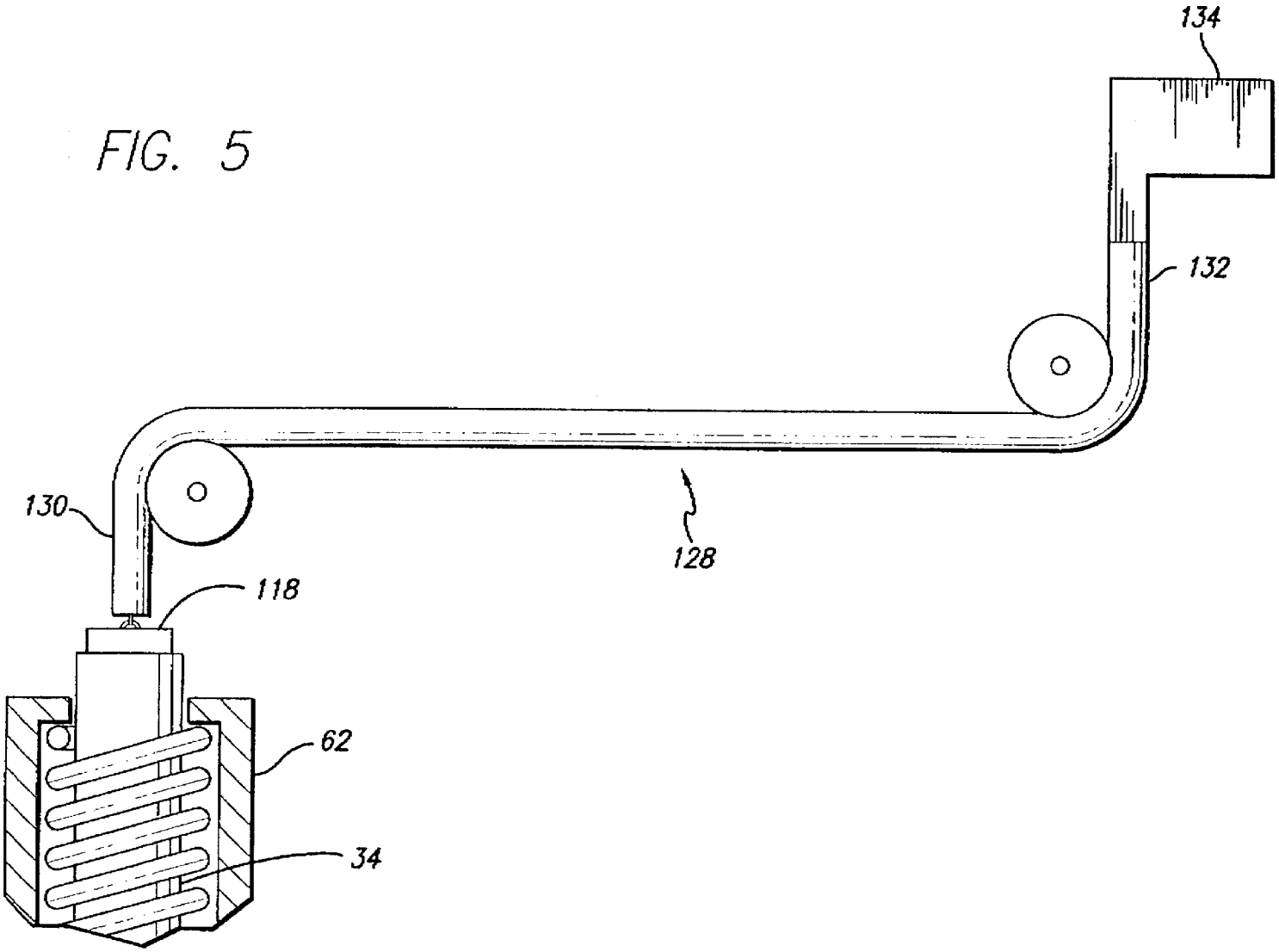
FIG. 5 is a schematic drawing of another embodiment of a keeper mechanism of the present invention, particularly illustrating a remote cabling system.

The present invention is capable of other and different embodiments, and its several details are capable of modification. For example, in reference to FIG. 5, a remote cabling system 128 is connected to the indicator 34 in order to indicate, in a more visible portion of the aircraft (not shown), whether or not the latch 12 is closed and loaded. A first end 130 of the remote cabling system is linked to the flag end 118 of the indicator and a second end 132 is connected to a remote flag 134 in a more visible portion of the aircraft. When the flag end extends outside of the housing extension 62, the remote flag extends.

Figure 6:
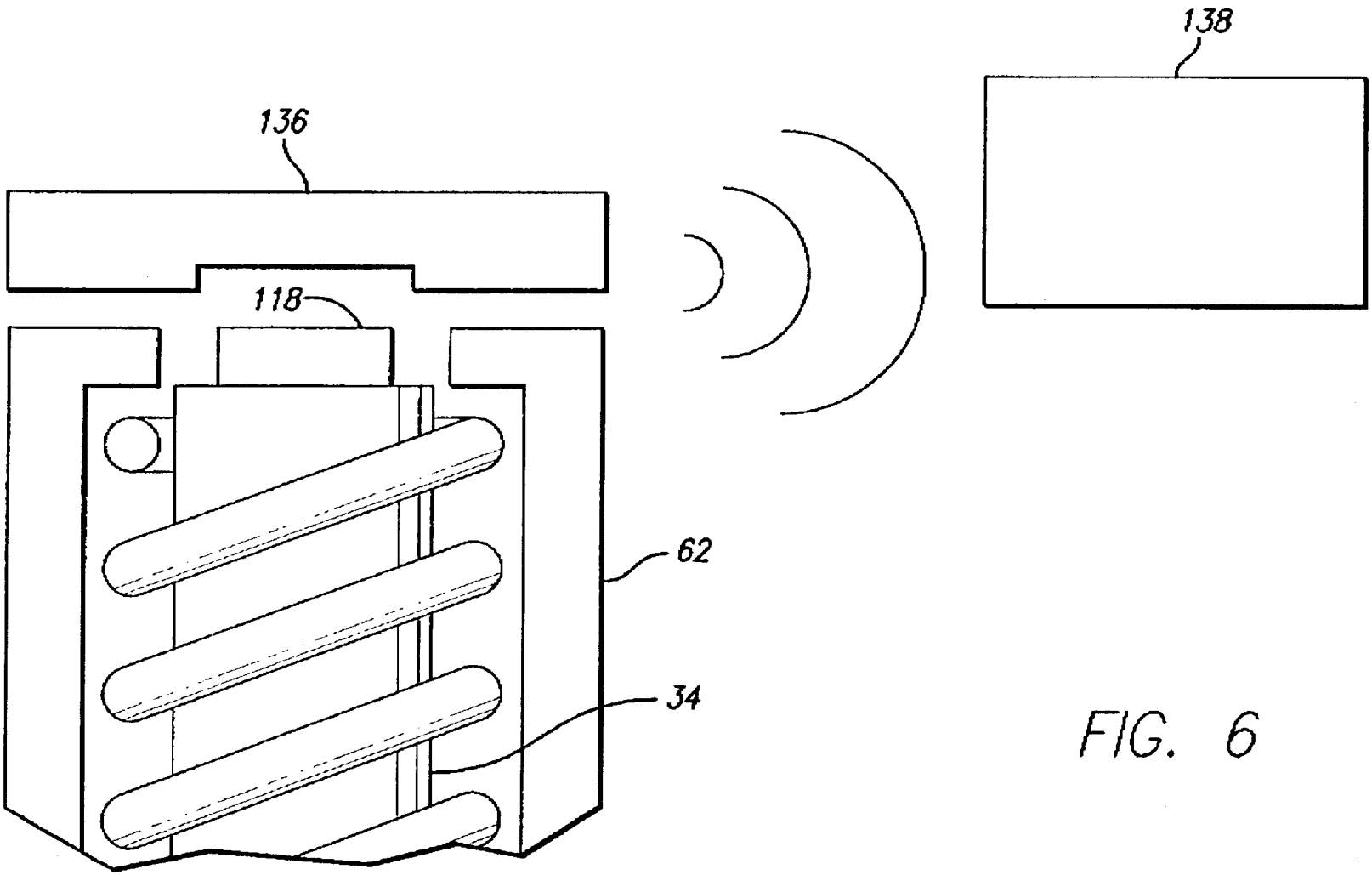
FIG. 6 is a schematic drawing of another embodiment of a keeper mechanism of the present invention, particularly illustrating an electronic monitoring device.

Alternatively, as shown in FIG. 6, the indicator 34 could actuate an electronic monitoring device 136 which contacts the flag end 118 of the indicator for remote monitoring of the latch 12. If the hook 14 becomes disengaged from the clevis 24 and the flag end extends outside of the housing extension 62, the electronic monitoring device generates and transmits an electrical signal to a remote device 138 in the aircraft (not shown) and/or on the ground alerting the aircrew or the ground crew, respectively, of the unsafe condition. This is particularly beneficial for warning the aircrew of a failure of the latch during flight.

Those skilled in the art will recognize that other modifications and variations can be made in the keeper mechanism 10 of the present invention and in the construction and operation of the keeper mechanism without departing from the scope or spirit of this invention. With such possibilities in mind, the invention is defined with reference to the following claims.

I claim:

1. A keeper mechanism utilized with a latch having a hook, the latch moveable between an unloaded position and a loaded position, the keeper mechanism comprising:

a housing having:
an exterior surface;
an interior surface,
opposing ends; and
a mounting wall connected to one of the ends of the housing, the mounting wall including an opening, a housing extension, having opposing ends, one end of the housing extension connects to the housing such that the housing extension protrudes from the exterior surface of the housing, the other end of the housing extension including an indicator opening;

a clevis, formed of a clevis opening, positioned outside of the housing, at one end of a clevis shaft, with the clevis shaft passing through the opening in the mounting wall and extending inside the housing;

an adjusting nut threadably mounted to the clevis shaft and positioned within the housing;

a detent spring mounted to the interior surface of the housing, the detent spring in sliding contact with the adjusting nut; and an indicator housed within the housing extension, the indicator including:
a bulb-shaped sensing end engaging the adjusting nut; and
a flag end, adjacent the indicator opening;

the indicator moveable between a flagged position, where the flag end extends outside of the housing extension for indicating when the latch is in an unloaded position, and an unflagged position, where the flag end does not extend outside of the housing extension for indicating when the latch is in a loaded position.

2. The keeper mechanism of claim 1, further comprising a biasing spring, having opposing ends, one end of the biasing spring adjacent the mounting wall, the other end of the biasing spring interfacing the adjusting nut.

3. The keeper mechanism of claim 1, wherein the adjusting nut includes:

opposing ends;

a front section adjacent the end of the adjusting nut located nearest the mounting wall;

an end section at the end of the adjusting nut located furthest from the mounting wall; and a sloped surface between the front section and the end section.

4. The keeper mechanism of claim 1, further comprising an adjustment slot in the housing adjacent the mounting wall.

5. The keeper mechanism of claim 4, further comprising a retaining ring connected to the interior surface of the housing between the adjustment slot and the housing extension.

6. The keeper mechanism of claim 1, wherein the detent spring includes at least one knee, the adjusting nut includes a plurality of grooves, and the at least one knee is in contact with at least one of the plurality of grooves.

7. The keeper mechanism of claim 1, wherein the indicator includes:

a lip adjacent the bulb-shaped sensing end; and a cylindrical indicator shaft extending from the bulb-shaped sensing end to the flag end.

8. The keeper mechanism of claim 7, further comprising an indicator spring mounted inside of the housing extension and surrounding the cylindrical indicator shaft between the lip and the indicator opening.

9. The keeper mechanism of claim 1, further comprising a remote cabling system having a first end connected to the flag end and a second end connected to a remote flag, the remote cabling system links the flag end to the remote flag so that the remote flag is extended when the flag end extends outside of the housing extension.

10. The keeper mechanism of claim 1, farther comprising an electronic monitoring device in operable contact with the flag end for generating an electrical signal when the flag end extends outside of the housing extension.

11. A keeper mechanism utilized with a latch having a hook, the latch moveable between an unloaded position and a loaded position, the keeper mechanism comprising:

a housing having:
an exterior surface;
an interior surface;
opposing ends; and
a mounting wall connected to one of the ends of the housing, the mounting wall including an opening;

a clevis, formed of a clevis opening, positioned outside of the housing, at one end of a clevis shaft, with the clevis shaft passing through the opening in the mounting wall and extending inside the housing;

an adjusting nut threadably mounted to the clevis shaft and positioned within the housing;

a detent spring mounted to the interior surface of the housing, the detent spring in sliding contact with the adjusting nut; and a biasing spring, having opposing ends, one end of the biasing spring adjacent the mounting wall, the other end of the biasing spring interfacing the adjusting nut.

12. The keeper mechanism of claim 11, wherein the adjusting nut includes:

opposing ends;

a front section adjacent the end of the adjusting nut located nearest the mounting wall;

an end section at the end of the adjusting nut located furthest from the mounting wall; and a sloped surface between the front section and the end section.

13. The keeper mechanism of claim 11, further comprising an adjustment slot in the housing adjacent the mounting wall.

14. The keeper mechanism of claim 11, wherein the detent spring includes at least one knee, the adjusting nut includes a plurality of grooves, and the at least one knee is in contact with at least one of the plurality of grooves.

15. The keeper mechanism of claim 11, wherein the housing includes a housing extension, having opposing ends, one end of the housing extension connects to the housing such that the housing extension protrudes from the exterior surface of the housing, the other end of the housing extension including an indicator opening.

16. The keeper mechanism of claim 15, further comprising a retaining ring connected to the interior surface of the housing between the mounting wall and the housing extension.

17. The keeper mechanism of claim 15, further comprising an indicator housed within the housing extension, the indicator including:

a sensing end engaging the adjusting nut; and a flag end, adjacent the indicator opening; the indicator moveable between a flagged position, where the flag end extends outside of the housing extension for indicating when the latch is in an unloaded position, and an unflagged position, where the flag end does not extend outside of the housing extension for indicating when the latch is in a loaded position.

18. The keeper mechanism of claim 17, wherein the sensing end of the indicator is bulb-shaped.

19. The keeper mechanism of claim 17, further comprising an indicator spring positioned inside of the housing extension and surrounding the indicator between the sensing end and the flag end.

20. The keeper mechanism of claim 17, further comprising a remote cabling system having a first end connected to the flag end and a second end connected to a remote flag, the remote cabling system links the flag end to the remote flag so that the remote flag is extended when the flag end extends outside of the housing extension.

21. The keeper mechanism of claim 17, further comprising an electronic monitoring device in operable contact with the flag end for generating an electrical signal when the flag end extends outside of the housing extension.

22. A keeper mechanism utilized with a latch having a hook, the latch moveable between an unloaded position and a loaded position, the keeper mechanism comprising:

a housing having:

an exterior surface;

an interior surface;

opposing ends;

a mounting wall connected to one of the ends of the housing, the mounting wall including an opening; and an adjustment slot adjacent the mounting wall;

a housing extension, having opposing ends, one end of the housing extension connects to the housing such that the housing extension protrudes from the exterior surface of the housing, the other end of the housing extension including an indicator opening;

a clevis, formed of a clevis opening, positioned outside of the housing, at one end of a clevis shaft, with the clevis shaft passing through the opening in the mounting wall and extending inside the housing;

an adjusting nut threadably mounted to the clevis shaft and positioned with in the housing, the adjusting nut includes:

opposing ends;

a front section adjacent the end of the adjusting nut located nearest the mounting wall;

an end section, having a plurality of grooves, located at the end of the adjusting nut furthest from the mounting wall; and a sloped surface between the front section and the end section;

a biasing spring, having opposing ends, one end of the biasing spring adjacent the mounting wall and the other end of the biasing spring interfacing the adjusting nut;

a retaining ring connected to the interior surface of the housing between the adjustment slot and the housing extension;

a detent spring, having at least one knee, mounted to the interior surface of the housing, the at least one knee in sliding contact with at least one of the plurality of grooves in the end section;

an indicator, housed within the housing extension, including:

a bulb-shaped sensing end engaging the adjusting nut;

a lip adjacent the bulb-shaped sensing end;

a flag end, adjacent the indicator opening; and a cylindrical indicator shaft extending from the lip to the flag end;

the indicator moveable between a flagged position, where the flag end extends outside of the housing extension for indicating when the latch is in an unloaded position, and an unflagged position, where the flag does not extend outside of the housing extension for indicating when the latch is in a loaded position; and an indicator spring mounted inside the housing extension and surrounding the cylindrical indicator shaft between the lip and the indicator opening.

* * * * *